US009293020B2

(12) United States Patent
Nguyen

(10) Patent No.: US 9,293,020 B2
(45) Date of Patent: Mar. 22, 2016

(54) ELECTRONIC ARTICLE SURVEILLANCE TAG WITH TAMPER RESISTANT MAGNETIC LOCK

(71) Applicant: Thang T. Nguyen, Boca Raton, FL (US)

(72) Inventor: Thang T. Nguyen, Boca Raton, FL (US)

(73) Assignee: Tyco Fire & Security GmbH, Neuhausen Am Rheinfall (CH)

( * ) Notice: Subject to any disclaimer, the term of this patent is extended or adjusted under 35 U.S.C. 154(b) by 143 days.

(21) Appl. No.: 14/204,669

(22) Filed: Mar. 11, 2014

(65) Prior Publication Data

US 2015/0262462 A1 Sep. 17, 2015

(51) Int. Cl.

| | |
|---|---|
| ***G08B 21/00*** | (2006.01) |
| ***G08B 13/24*** | (2006.01) |
| ***E05B 73/00*** | (2006.01) |

(52) U.S. Cl.

CPC ..... *G08B 13/2434* (2013.01); *E05B 73/0017* (2013.01); *Y10T 70/413* (2015.04)

(58) Field of Classification Search

CPC ..... E05B 45/005; E05B 73/0052; E05B 73/0017; E05B 73/0023; E05B 73/0041; G08B 13/2434; Y10T 70/7904

USPC ..... 340/5.73, 572.9

See application file for complete search history.

(56) References Cited

U.S. PATENT DOCUMENTS

| | | | | |
|---|---|---|---|---|
| 2003/0047530 | A1* | 3/2003 | Durbin | E05B 73/0041 215/207 |
| 2008/0266111 | A1* | 10/2008 | Shute | G09F 3/0358 340/572.9 |
| 2008/0291025 | A1* | 11/2008 | Perez | E05B 73/00 340/572.1 |
| 2012/0152883 | A1 | 6/2012 | Zhang | |
| 2012/0326871 | A1 | 12/2012 | Lian | |
| 2014/0123714 | A1* | 5/2014 | Ho | E05B 73/0017 70/57.1 |

FOREIGN PATENT DOCUMENTS

WO 0175254 A1 10/2001

* cited by examiner

*Primary Examiner* — Mark Rushing

(74) *Attorney, Agent, or Firm* — Fox Rothschild, LLP; Robert J. Sacco; Carol E. Thorstad-Forsyth

(57) ABSTRACT

Method for operating a magnetically controlled lock in an EAS tag (100) involves the application of a magnetic field to a plunger (322) within a housing (102) of the EAS tag. The applied magnetic field is used to cause a translational movement of the plunger in a first direction. The method can further involve causing a latch (320) to pivot about a pivot axis (807) by using the translational motion (1002) of the plunger to apply a torque (1004) to the latch. Rotation of the latch in this way causes it to move to an unlocked position which releases a locking pin (106).

22 Claims, 7 Drawing Sheets

ELECTRONIC ARTICLE SURVEILLANCE TAG WITH TAMPER RESISTANT MAGNETIC LOCK

BACKGROUND OF THE INVENTION

1. Statement of the Technical Field

The inventive arrangements relate to electronic article surveillance tags and more particularly to magnetically controlled locks which are used to secure such tags to articles.

2. Description of the Related Art

Electronic article surveillance systems are well known in the art. These systems utilize EAS tags containing sensor elements that can be detected when moved to a detection zone of an EAS system. The tags are generally attached to merchandise and are either removed or deactivated by store clerks when an authorized person wishes to purchase the item from the secured premises. Several different types of EAS systems are known in the art including magnetic systems, acousto-magnetic systems, radio-frequency systems and microwave type systems. All such systems require an EAS tag to be secured to items which are to be protected by the EAS system.

Conventional electronic article surveillance (EAS) tags often utilize a lock of some type to facilitate securing of the tag to an item of merchandise. Mechanical and magnetic type locks are known and each has benefits and drawbacks. For example, magnetic locks suffer from a common problem which allows the lock to be momentarily unlatched when the tag is impacted upon a hard surface. The amount of force required to cause unlocking is dependent upon the design of the lock, and more particularly upon a spring that is used to retain the lock in a latched condition. Lighter springs exerting less spring force are designed to work with lower strength magnetic detachers and heavier springs exerting more spring force are designed to work with higher strength magnetic detachers. But regardless of spring weight used, the un-authorized unlocking of EAS tags by striking them upon a surface is known problem. The spring which retains the device in a locked condition will compress and the lock will momentarily transition to an unlocked condition.

SUMMARY OF THE INVENTION

The invention concerns a magnetic lock that is resistant to defeat caused by forceful impacts. The lock includes a housing formed of a rigid material. A pin channel is defined within the housing. The pin channel is arranged to removably receive therein a locking pin along a pin channel axis. A latch assembly is disposed within the housing. The latch assembly includes a latch disposed adjacent to the pin channel. The latch is pivotally mounted within the housing, and is configured to lockingly engage the locking pin when in a first pivot position. The latch is also configured to release the locking pin in a second pivot position. The latch assembly also includes a plunger formed of material responsive to an applied magnetic field. The plunger has an engagement face which interacts with a base portion of the latch. A plunger guide channel is formed in the housing and is arranged to facilitate translational movement of the plunger along a guide channel axis. The plunger can thus move from a first position to a second position within the guide channel when the plunger is exposed to the applied magnetic field. A resilient member is arranged to resiliently urge the engagement face of the plunger into contact with a base of the latch. The latch is responsive to the translational movement of the plunger from the first position to the second position to cause the latch to move from the first pivot position to the second pivot position described above.

According to another aspect, the invention concerns a method for operating a magnetically controlled lock in an EAS tag. The method involves the application of a magnetic field to a plunger element within a housing of the EAS tag. The applied magnetic field is used to cause a translational movement of the plunger in a first direction. The method can further involve causing a latch to pivot about a pivot axis by using the plunger to apply a torque to a latching element. Rotation of the latch in this way causes it to move to an unlocked position in which the latch releases a locking pin.

According to a further aspect, the inventive arrangements concern an electronic article surveillance tag with a tamper resistant magnetically controlled lock. The EAS tag includes a tag housing and a rotatable latch disposed within the tag housing. The latch is arranged to selectively engage and disengage a movable locking pin in accordance with a rotation position. A plunger is disposed within the tag housing in a guide channel which facilitates translational movement of the plunger within the tag housing along a translation axis. The plunger is arranged to apply a torque to the latch responsive to movement of the plunger in a first direction along the translational axis in the presence of an applied magnetic field. This torque causes the latch to rotate, whereby the latch is caused to disengage from the locking pin.

BRIEF DESCRIPTION OF THE DRAWINGS

Embodiments will be described with reference to the following drawing figures, in which like numerals represent like items throughout the figures, and in which.

DETAILED DESCRIPTION

Figure 1:
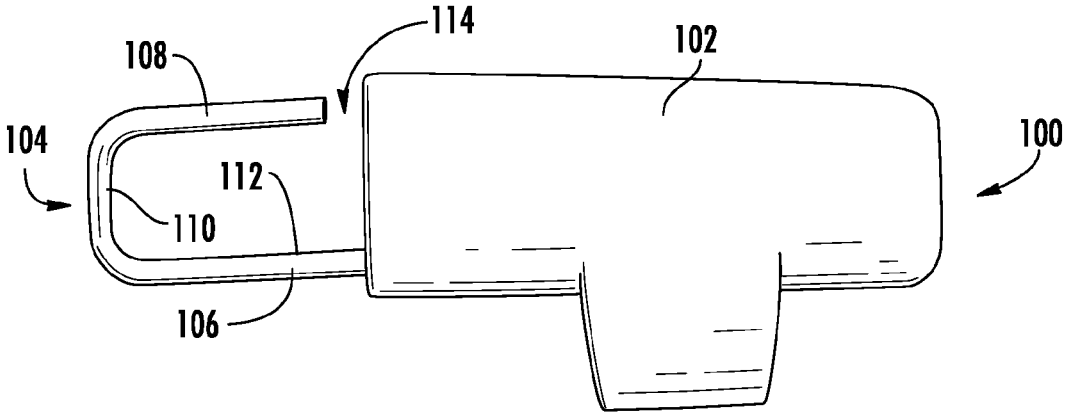
FIG. 1 shows an EAS tag in an unlocked condition which is useful for understanding the inventive arrangements.

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The inventive arrangements generally concern magnetically controlled locks, and more particularly concern methods and apparatus involving such locks which are useful for preventing unauthorized unlocking caused by forceful impacts directed upon the lock. The magnetically controlled locks described herein are particularly useful for inclusion in electronic article surveillance (EAS) tags, where they can be used for purposes of securing the EAS tag to an article of merchandise.

A method for operating a magnetically controlled lock in an EAS tag as described herein involves the application of a magnetic field to a plunger element within a housing of the EAS tag. The applied magnetic field is used to cause a translational movement of the plunger in a first direction. The method can further involve causing a latch to pivot about a pivot axis by using the translational motion of the plunger to apply a torque to a latching element. Rotation of the latch in this way causes it to move to an unlocked position which releases a locking pin. The latch is returned to its original locked position by causing the plunger to move in an opposite direction, thereby causing a second torque to be applied to the latch. The direction of the second torque is opposed to the direction of the first torque.

An EAS tag which facilitates the above-described method is resistant to unauthorized unlocking caused by repeated striking of the lock upon a rigid surface. Such a tag advantageously includes a rigid housing and a rotatable latch disposed within the housing. As explained above, the latch is arranged to selectively engage and disengage a movable locking pin within the housing in accordance with a rotation position of the latch about a pivot axis. A plunger, which is separate from the latch, is disposed within the tag housing in a guide channel. The guide channel facilitates translational movement of the plunger within the tag housing along a translation axis.

The plunger is arranged to apply a first torque to the latch in a first rotation direction. More particularly, the first torque is applied to the latch responsive to movement of the plunger. The plunger moves from a first plunger position to a second plunger position in response to the presence of an applied magnetic field. This movement of the plunger is in a first direction aligned with the translation axis. The first torque rotates the latch from a first rotation position (in which the latch engages the locking pin to provide a locked condition), to a second rotation position (in which the latch is disengaged from the locking pin, thereby creating an unlocked condition). In the locked condition, the locking pin is restrained in its movement due to the engagement of the latch. When in such condition, the locking pin is prevented from being moved in at least one direction relative to the lock housing. For example, the locking pin can be restrained from movement which involves extraction of the pin from the lock housing. Conversely, in the unlocked position, the locking pin is no longer restrained in its motion by the latch.

The plunger described herein is advantageously biased toward the latch using a resilient member, such as a spring. The resilient bias comprises a spring force applied to the plunger in a direction toward the latch. For example, a direction of the spring force can be aligned with the translation direction. When the applied magnetic field is removed, the resilient bias causes the plunger to move from the second plunger position to the first plunger position in a second direction opposed to the first direction. As a result of such action, the plunger applies a second torque to the latch, opposed to the first torque. The second torque causes the latch to rotate in a second rotation direction opposed to the first rotation direction. The rotation of the latch causes it to move from the second rotation position to the first rotation position. When the latch is in the first rotation position, the latch re-engages the locking pin.

Figure 2:
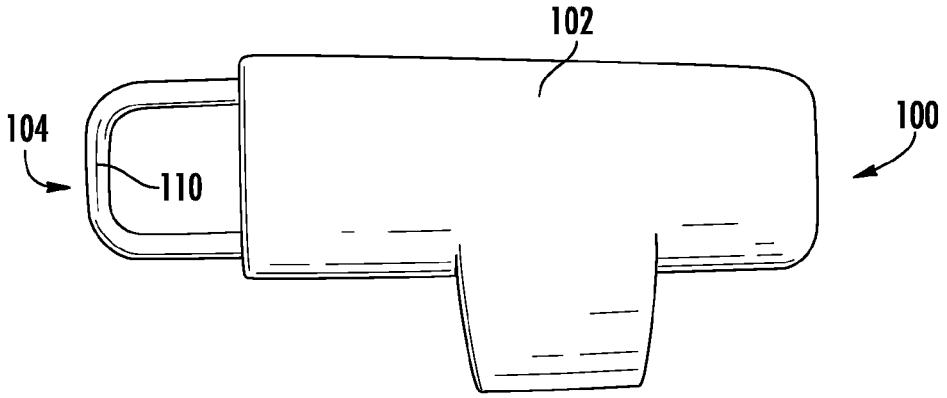
FIG. 2 shows the EAS tag of FIG. 1 in a locked condition.

The inventive arrangements will now be described in detail with reference to FIGS. 1-7. Referring now to FIGS. 1 and 2 there is shown an EAS tag 100 which includes a magnetically controlled lock. The EAS tag is comprised of a housing 102 formed of a suitable rigid material. The rigid material can be a polymer or any other type of rigid non-magnetic material. The housing 102 encloses a latch assembly (not shown in FIGS. 1 and 2) which forms a portion of a magnetically controlled lock. The latch assembly is configured to selectively constrain the motion of a locking pin 106. In the embodiment shown, the locking pin 106 forms a part of a shackle 104. The shackle is formed in the shape of a hook to define a shackle heel 112, a shackle toe 108, and a curved crown 110 disposed between the locking pin and the thereof. When unlocked, the shackle can be partially extracted from the housing 102 to create a gap 114. This gap allows the shackle to be inserted through a portion of an item to which the tag is to be attached. Consequently, when the shackle is closed as shown in FIG. 2, the EAS tag cannot be removed from the item. The latch assembly (not shown in FIGS. 1 and 2) controls the operation of the shackle by determining when the locking pin 106 can be moved from a locked position (e.g. the position shown in FIG. 2) to the unlocked position (e.g. the position shown in FIG. 1).

Figure 3:
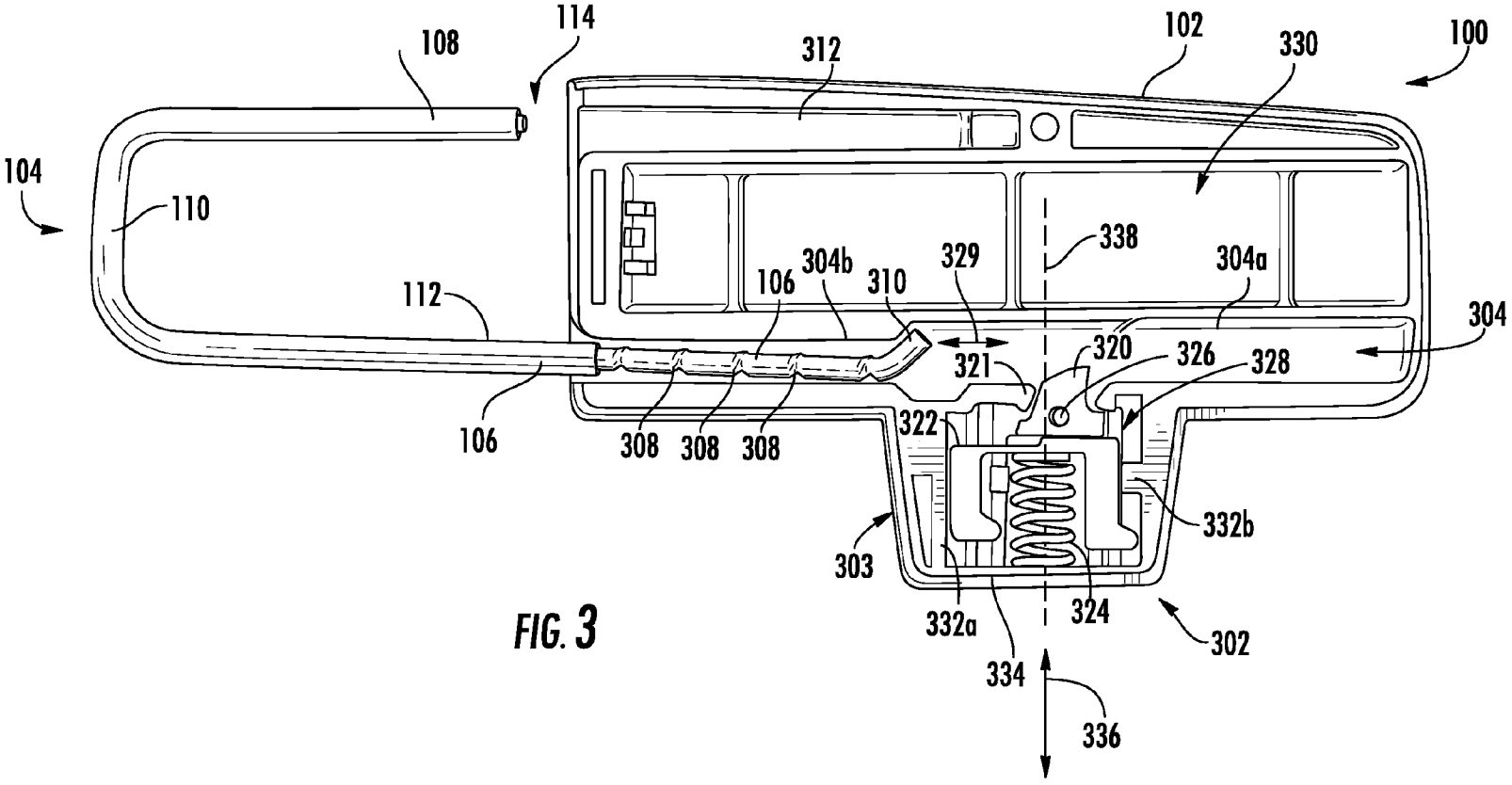
FIG. 3 shows the EAS tag in FIG. 1 with a cover portion removed to expose an internal structure.
Figure 4:
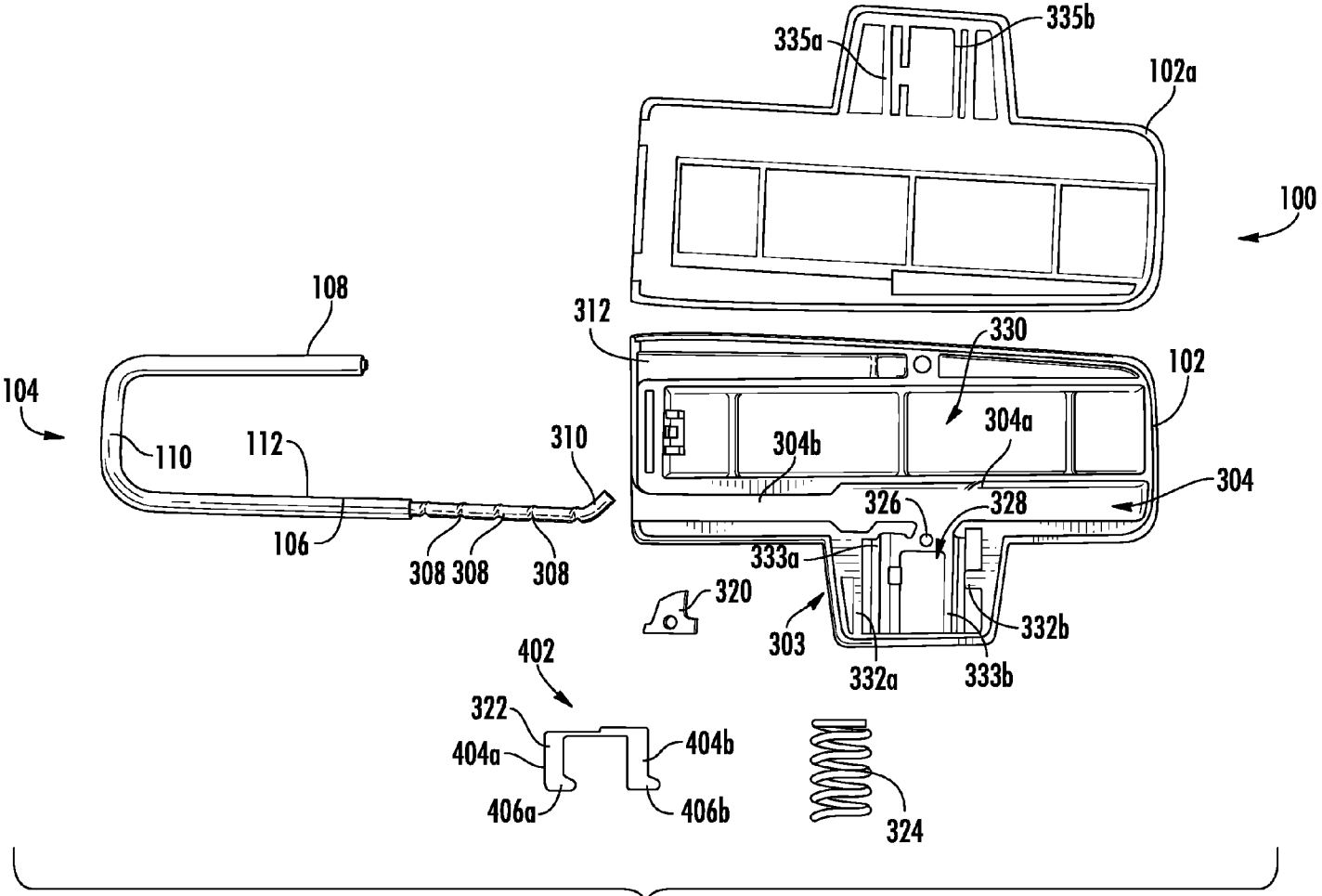
FIG. 4 shows an exploded view of the EAS tag in FIG. 1 that is useful for understanding the internal structure.

In FIG. 3, the EAS tag 100 is shown with a cover part 102*a* of the housing removed to reveal certain internal features. The disassembled EAS tag in FIG. 4 shows the cover part 102*a*, and certain internal details of the housing 102. The EAS tag includes a sensor compartment 330 in which a sensor element (not shown) can be provided. The sensor element can be any type of EAS sensing element now known or known in the future that is useful to facilitate detection of the EAS tag in an EAS system. For example, a sensor designed for use in an acousto-magnetic type EAS system can be made of a strip of magnetostrictive, ferromagnetic amorphous metal and a magnetically semi-hard metallic strip. The sensor could also be an RFID type sensor. Sensor elements for electronic article surveillance systems are well known in the art and therefore will not be described herein in detail.

As shown in FIG. 3, the housing 102 encloses a latch assembly 302 comprised of several latch components which are all disposed within a portion of the housing referred to herein as latch enclosure 303. The latch components include a movable plunger 322, a resilient member (e.g. a spring) 324, and a latch 320 which is arranged to rotate on a pivot 326. The housing also defines a pin channel 304 which includes an inner portion 304*a* and an outer portion 304*b*. The locking pin 106 is disposed within the pin channel 304 so that it can move in the directions indicated by arrow 329. The pin channel is arranged to constrain a movement of the locking pin along a linear path aligned with 329, transverse to the movement directions 336 associated with the plunger. The locking pin includes several notches 308 along its length which can be engaged by a portion of the latch when the latch is in its locked position. A nub 310 disposed on a portion of the locking pin interacts with the internal structure of the pin channel to prevent the locking pin from being entirely extracted from the housing.

The plunger 322 is disposed within a guide channel 328 formed in the latch enclosure 303. The guide channel is defined by guide walls 332*a*, 332*b* and slide rails 333*a*, 333*b*, 335*a*, 335*b*. A base panel 334 is disposed at one end of the guide channel to complete the enclosure. The guide walls 332*a*, 332*b*, slide rails 333*a*, 333*b*, 335*a*, 335*b* and base panel 334 serve to limit the linear translational motion of the plunger as it moves within the channel. More particularly, the guide channel facilitates translational movement of the plunger in directions indicated by arrow 336. The movement of the plunger is thus defined within the tag housing along a translation axis 338.

As best understood with reference to FIG. 4, the plunger 322 is a substantially planar element having an inverted U-shaped form. The plunger is formed of a ferromagnetic material such as carbon steel. The plunger has an engagement face 402, first and second legs 404*a*, 404*b*, and bump-stops 406*a*, 406*b* disposed on an end of each leg. The engagement face 402 is comprised of a stepped surface. As best understood with reference to FIG. 8, the stepped surface of the engagement face includes a first portion 802*a* and a second portion 802*b* which is offset from the first portion in a direction aligned with the translation axis 338. A transition region 814 extends between the first and second portions to complete the stepped surface. Notably, the second portion 802*b* of the stepped engagement surface 402 extends closer to the base than the first portion 802*a*. Stated differently, it could be said that the first portion 802*a* is displaced relative to the base 808.

Figure 8:
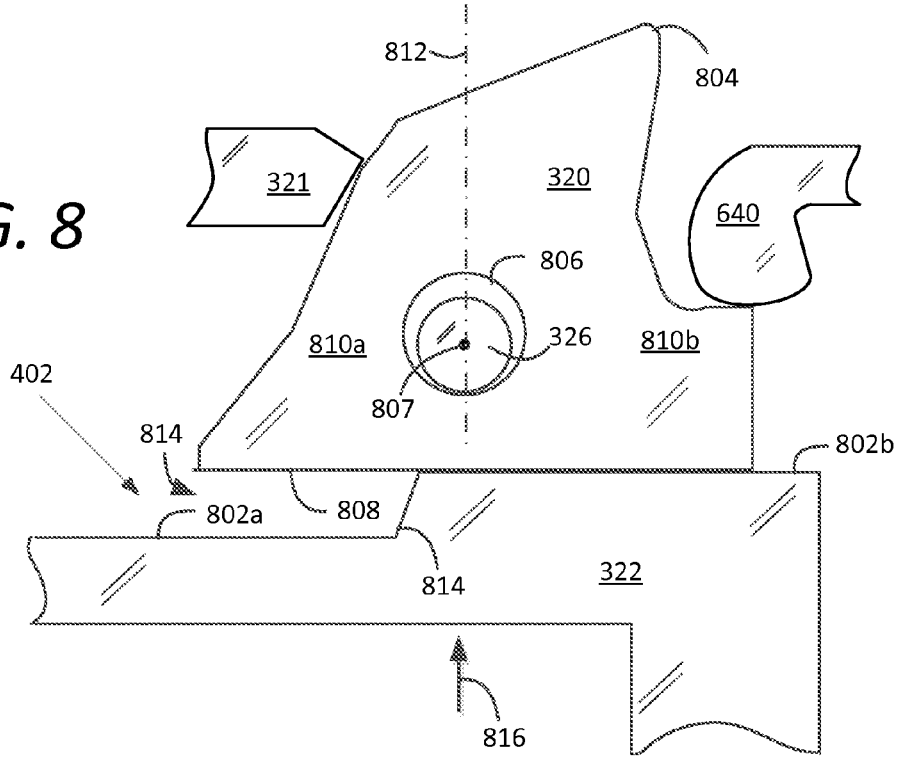
FIG. 8 is an enlarged view of a latch assembly in the condition shown in FIG. 5.
Figure 9:
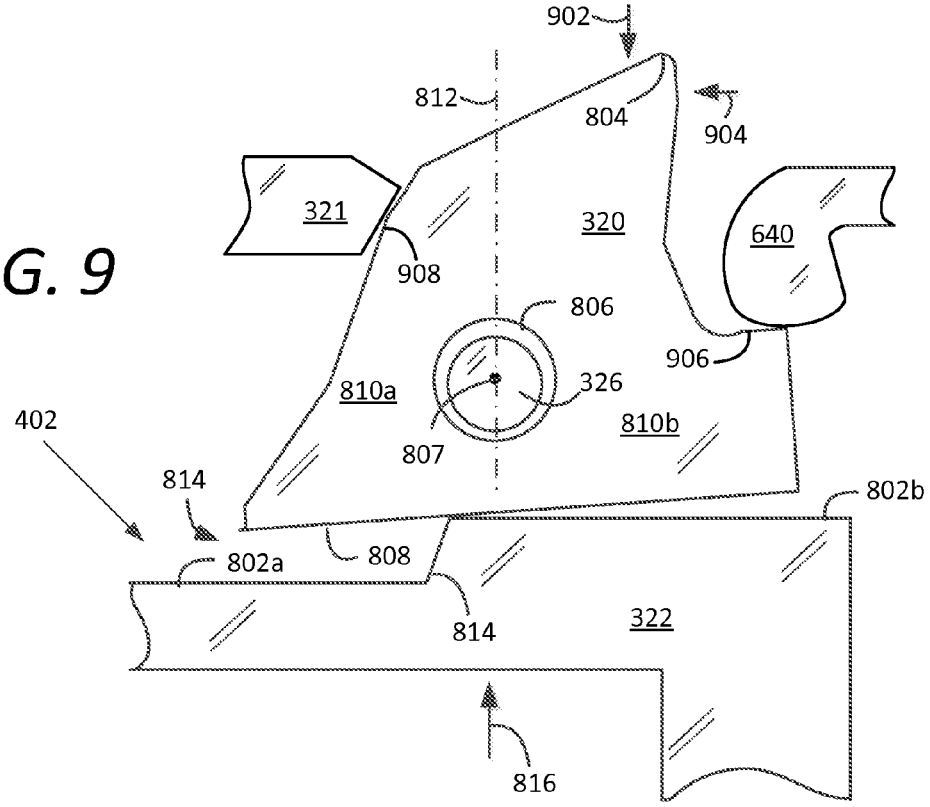
FIG. 9 is an enlarged view of a latch assembly in the condition shown in FIG. 6.

The latch 320 is a substantially planar element which has an irregular shape or profile. The latch is formed of a ferromagnetic material such as carbon steel. As shown in FIG. 8, the latch 320 includes a tooth 804 which is generally cog-shaped to snugly fit or catch in any of the several notches 308 defined along the length of the locking pin. The latch also includes a base 808. The base is arranged to rest on at least a portion of the engagement face 402. The latch has a bore 806 formed therein which defines a pivot axis 807 of the latch. The bore 806 facilitates rotation of the latch on pivot 326 under certain conditions which are described below in greater detail.

The pivot axis of the latch about which the latch rotates is offset from a center of mass of the latch. A lateral line 812 extending through the pivot axis is provided in FIG. 8 to define first and second lateral portions 810*a*, 810*b*. According to one aspect of the inventive arrangements, the second lateral portion 810*b* has greater mass than the first lateral portion 810*a*. Notably, the base can comprise a substantially planar surface extending along a bottom portion of the latch. Consequently a gap 814 can be formed between at least a part of the engagement face 402 and that portion of the base 808 associated with first lateral portion 810*a*. For example, the gap 814 can be formed between portion of the base 808 associated with first lateral portion 810*a* and the first portion 802*a* of the engagement face.

Figure 5:
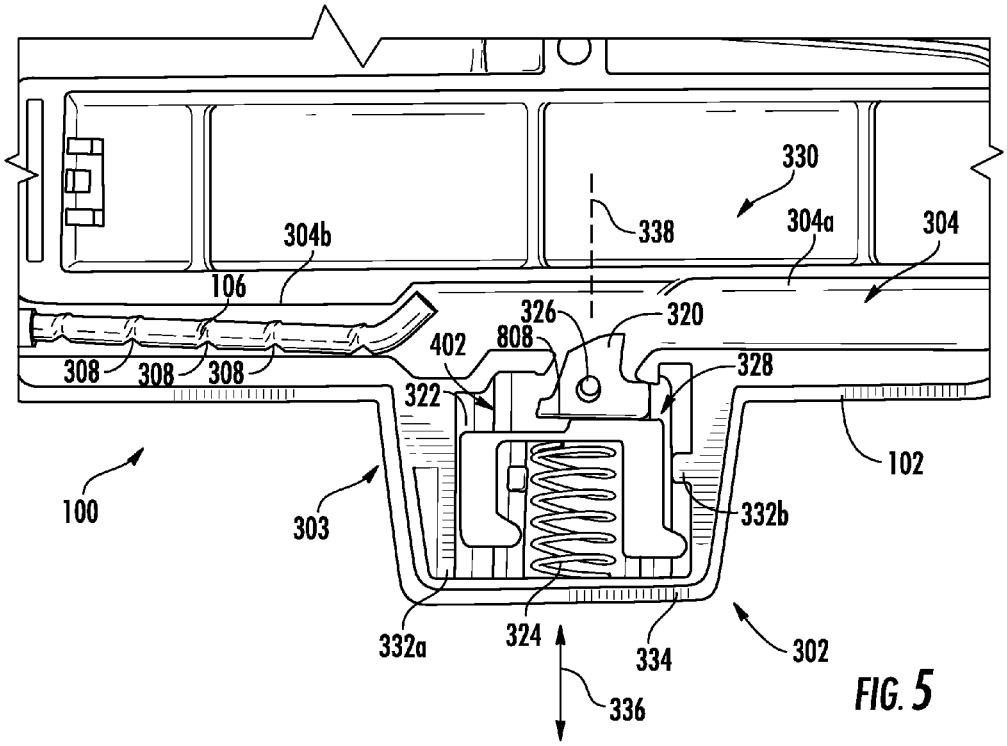
FIG. 5 is a more detailed view of a portion of the EAS tag shown in FIG. 3, in which a locking pin is fully disengaged from a latch.

Referring now to FIGS. 5-9, the operation of the latch assembly 302 will be described in further detail. FIG. 5 shows a condition of the latch assembly in the absence of any substantial applied magnetic field, with the locking pin displaced from the latch 320 such that the two are not engaged. The foregoing scenario is illustrated in greater detail in FIG. 8 which shows that a spring force 816 is applied by the resilient member to the plunger 322. This force urges the engagement surface of the plunger upwardly against the base of the latch. Notably, because of the stepped the stepped engagement surface 402, the first portion 802*a* is offset or displaced from the base by gap 814 when the second portion is in contact with the base. Further, the second portion 802*b* in contact with the base is advantageously arranged to fully extend beneath the pivot axis 807. Consequently, the spring force 816 directed against the latch will be counteracted by pivot 326, rather than imparting a rotational torque upon the latch.

Figure 6:
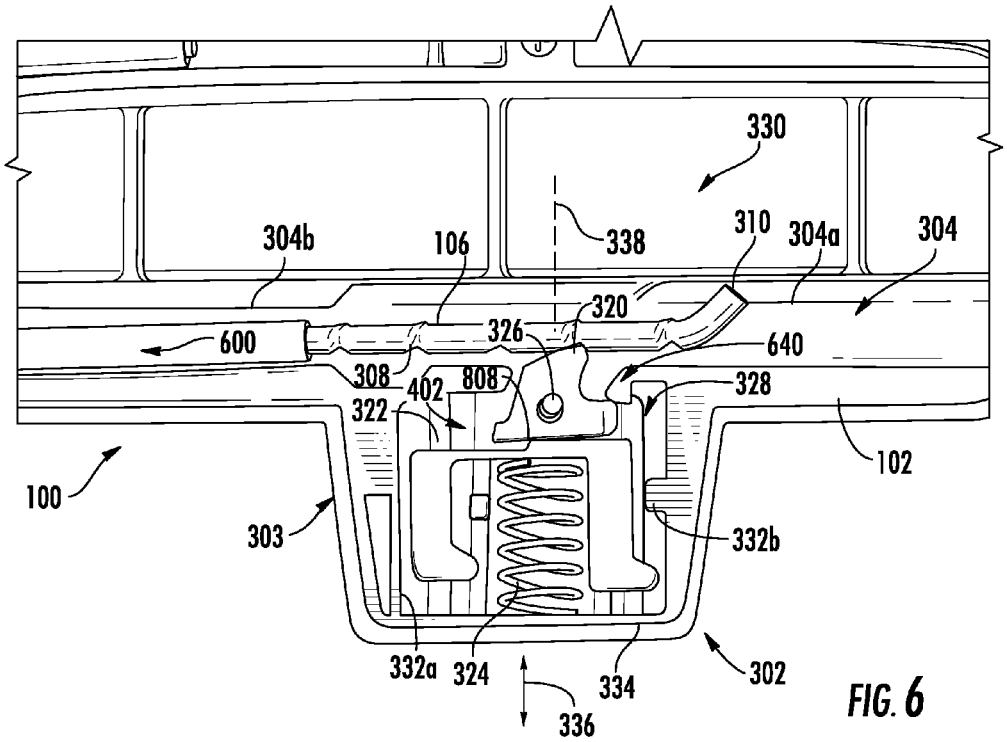
FIG. 6 is a more detailed view of a portion of the EAS tag shown in FIG. 3 shown in a locked condition where a latch is engaged with the locking pin.

In the scenario shown in FIG. 6, the latch assembly is again absent of any influence from any substantial applied magnetic field. However, the locking pin in FIG. 6 is now engaged with the latch. More particularly, the tooth of the latch 320 is engaged in a notch 308 of the locking pin so as to prevent the locking pin from being extracted any further from the housing. The foregoing scenario is illustrated in greater detail in FIG. 9 which shows that a spring force 816 is applied by the resilient member to the plunger 322. This force urges the engagement surface of the plunger upwardly against the base of the latch as described above. But in this scenario the latch is also acted upon by a downwardly directed force 902 exerted by the locking pin. In this condition, any attempt to extract the locking pin from the pin channel by pulling in a direction 600 will be prevented. More particularly, any extraction force exerted upon the pin will apply a transverse force 904 upon the tooth 804. This transverse force 904 may cause the latch to shift somewhat in its position on the plunger engagement surface as shown. However, any substantial counter-clockwise rotation of the latch is inhibited by the interaction of the latch with a wedge 640. More particularly a first bumper face 906 formed on a portion of the latch engages the wedge to resist rotation of the latch. Consequently, the latch prevents the locking pin from being extracted. A second bumper face 908 formed on an opposing surface of the latch engages a ledge 321 to resist further rotation of the latch. Accordingly, the scenario shown in FIG. 6 represents a locked condition.

Figure 7:
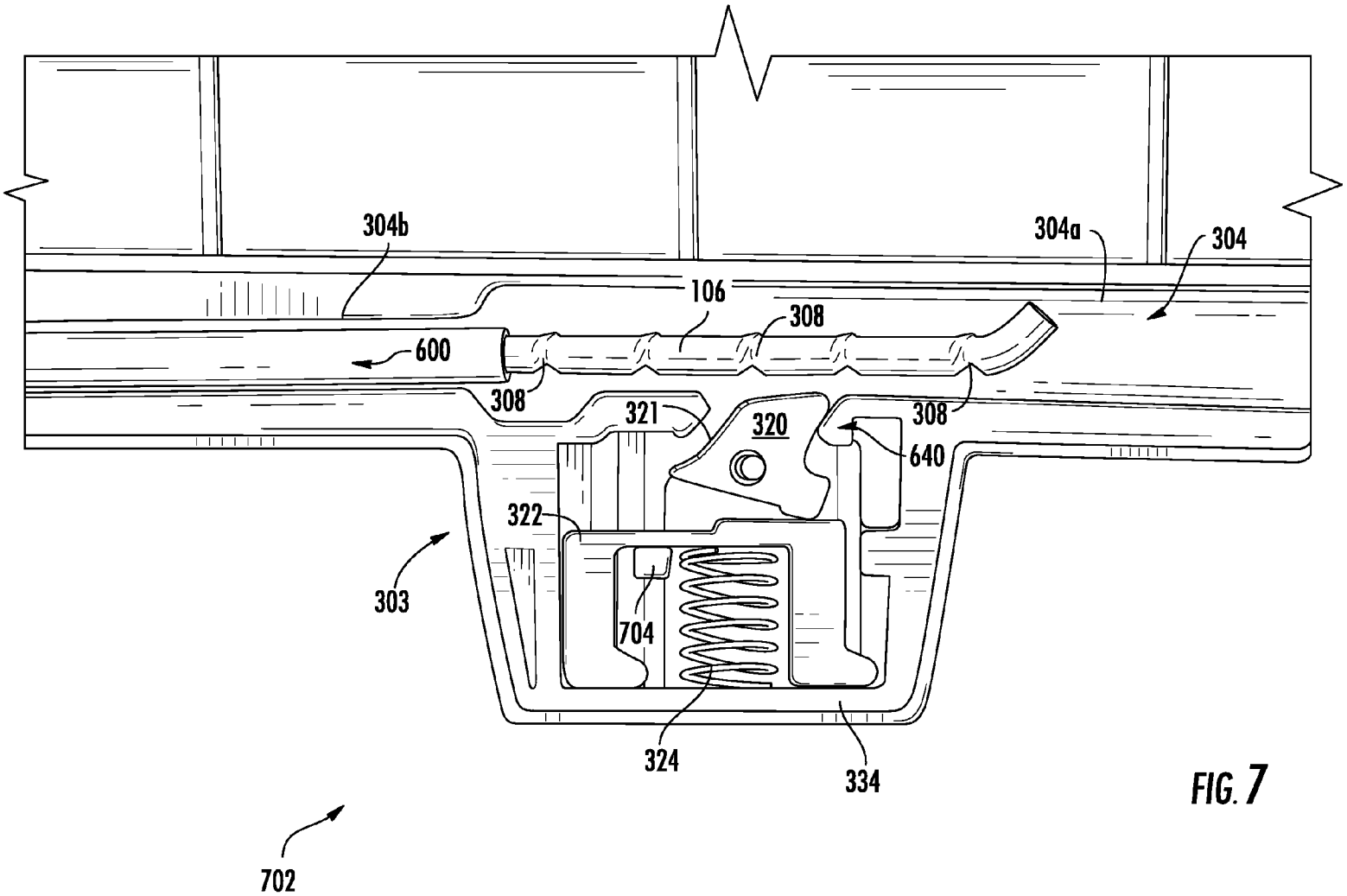
FIG. 7 is a more detailed view of a portion of the EAS tag shown in FIG. 3, shown in an unlocked condition.
Figure 10:
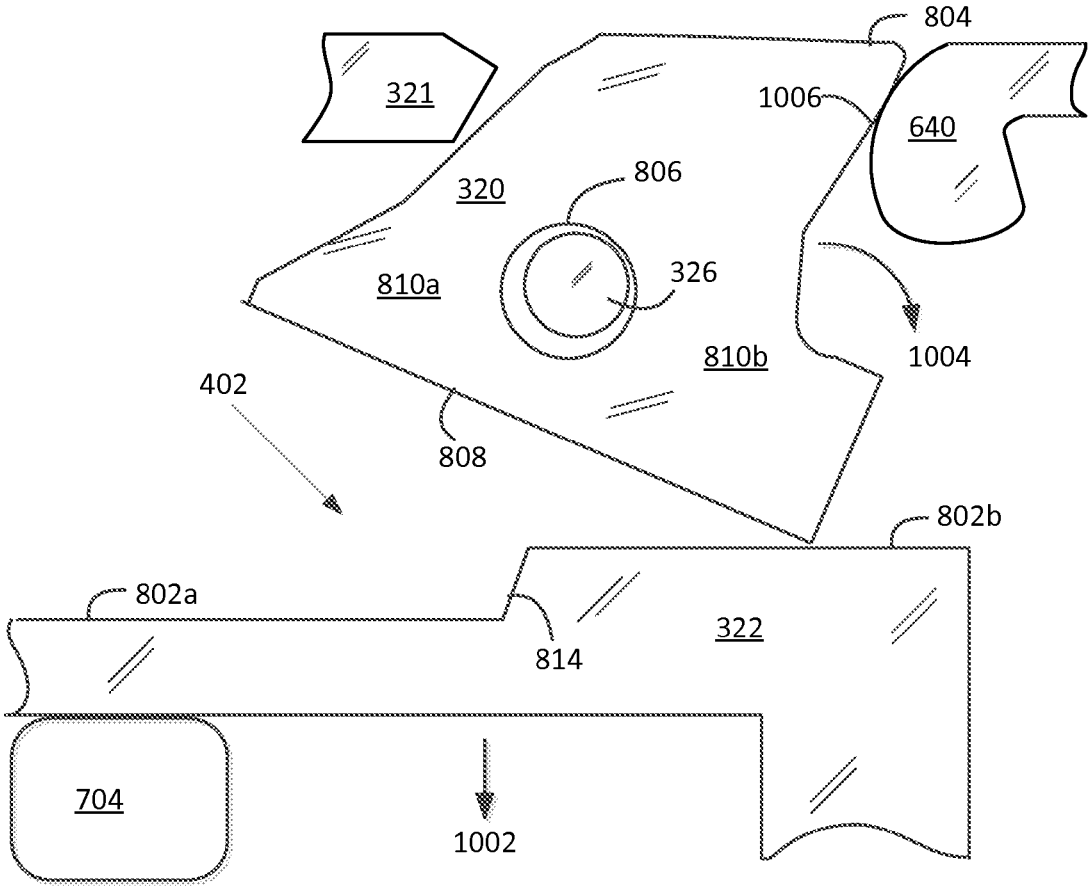
FIG. 10 is an enlarged view of a latch assembly in the condition shown in FIG. 7

Referring now to FIG. 7, the locking pin can be released from the latch by positioning the latch assembly in the presence of a sufficiently strong magnetic field. For example a permanent magnet 702 can be placed at the base panel 334 to provide the magnetic field described herein. An enlarged view of the latch assembly under these conditions is shown in FIG. 10. When exposed to a sufficiently powerful magnetic field, the plunger 322 will, as a result of magnetic attraction, move in the guide channel 328 in a direction 1002. The plunger is formed of a ferromagnetic material and is not necessarily a magnet itself. However, when the plunger 322 is positioned in the presence of a strong magnetic field as described herein, the non-magnetized plunger 322 will itself become magnetized due to the effects of induced magnetism.

As noted above, the latch rotates on a pivot axis that is offset from a center of mass of the latch. Also recall that the second lateral portion 810*b* of the latch has greater mass as compared to the first lateral portion 810*a*. The (now magnetized) plunger will form a magnetic attraction to the latch due to the induced magnetism. In other words, the latch is magnetically coupled to the plunger when the plunger is in the presence of the applied magnetic field. Due to the greater mass of the second lateral portion 810*b*, the magnetic field from the plunger will exert a greater force on the second lateral portion 810*b* as compared to 810*a*. The stepped engagement surface at the interface between the plunger and the latch also facilitates a greater magnetic force being applied to the second lateral portion. More particularly, the gap 814 between the plunger engagement face 402 and the base of the latch on the side of the first lateral portion 810*a* reduces the magnetic force exerted upon the latch on that side. The overall configuration will result in a stronger magnetic force being applied to the latch on the second lateral portion as compared to the first lateral portion. This net result is a torque 1004 applied to the latch in a clockwise direction as shown. The applied torque will cause rotation of the latch 320 in the direction of the applied torque. The limit of such rotation can be fixed by the presence of wedge 640 which interacts with a third bumper face 1006 formed on a portion of the latch 320 associated with tooth 804. The limit of such rotation can also be controlled by interaction of the plunger body with a post 704.

The rotation or pivot motion of the latch described herein results in the latch moving to an unlatched state as shown in FIG. 7. It can be observed in FIG. 7 that the tooth of the latch has disengaged from the notches defined in the locking pin so that the locking pin can move freely within the channel. When in this unlatched or unlocked state, the locking pin can be moved along direction 600 within the pin channel so that it can be at least partially extracted from the lock housing. Once the locking pin has been extracted in this way, the latch can be allowed to return to the latched or locked condition by moving the latch assembly away from the magnetic field of the magnet. In the absence of the magnetic field, the plunger will return to the position shown in FIG. 5 as a result of the resilient bias force applied to the plunger by the spring. Under these conditions, the plunger will exert a further torque upon the latch, causing it to rotate back to its initial position shown in FIG. 5.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

I claim:

1. A magnetic lock that is resistant to defeat caused by forceful impacts, comprising:

a housing formed of a rigid material;

a shackle having a first end slidable within a first channel defined in the housing and a second end which is removable from a second channel defined in the housing which is offset from the first channel;

a locking pin disposed within the housing so as to secure the shackle to the housing;

a pin channel defined within the housing, the pin channel arranged to removably receive therein the locking pin along a channel axis so that the magnetic lock is coupleable to and decoupleable from an item at least partially by using the locking pin and shackle, where the item is to be protected by the magnetic lock;

a latch assembly disposed within the housing, the latch assembly including a latch disposed adjacent to the pin channel, the latch pivotally mounted within the housing, the latch configured to lockingly engage the locking pin when in a first pivot position in which the magnetic lock is securely coupled to the item, and to release the locking pin in a second pivot position in which the magnetic lock is decoupleable from the item, a plunger formed of a material responsive to an applied magnetic field, the plunger including an engagement face, a plunger guide channel formed in the housing, the plunger guide channel arranged to facilitate translational movement of the plunger along a guide channel axis from a first position to a second position when the plunger is exposed to the applied magnetic field, and a resilient member arranged to resiliently urge the engagement face of the plunger into contact with a base of the latch;

wherein a first torque is applied to the latch responsive to the translational movement of the plunger from the first position to the second position so as to cause the latch to rotate from a first pivot position in which the latch engages the locking pin to a second pivot position in which the latch is disengaged from the locking pin.

2. The magnetic lock according to claim 1, wherein the latch is comprised of a material responsive to the application of a magnetic field and the latch is magnetically coupled to the plunger.

3. The magnetic lock according to claim 2, wherein a pivot axis of the latch about which the latch pivots is offset from a center of mass of the latch, and wherein a second lateral portion of the latch on one side of the pivot axis has greater mass than a first lateral portion of the latch on an opposing side of the pivot axis.

4. A magnetic lock that is resistant to defeat caused by forceful impacts, comprising:

a housing formed of a rigid material;

a pin channel defined within the housing, the pin channel arranged to removably receive therein a locking pin along a channel axis;

a latch assembly disposed within the housing, the latch assembly including a latch disposed adjacent to the pin channel, the latch pivotally mounted within the housing, the latch configured to lockingly engage the locking pin when in a first pivot position, and to release the locking pin in a second pivot position, a plunger formed of material responsive to an applied magnetic field, the plunger including an engagement face, a plunger guide channel formed in the housing, the plunger guide channel arranged to facilitate translational movement of the plunger along a guide channel axis from a first position to a second position when the plunger is exposed to the applied magnetic field, and a resilient member arranged to resiliently urge the engagement face of the plunger into contact with a base of the latch;

wherein the latch is responsive to the translational movement of the plunger from the first position to the second position to cause the latch to move from the first pivot position to the second pivot position;

wherein the latch is comprised of a material responsive to the application of a magnetic field and the latch is magnetically coupled to the plunger;

wherein a pivot axis of the latch about which the latch pivots is offset from a center of mass of the latch, and wherein a second lateral portion of the latch on one side of the pivot axis has greater mass than a first lateral portion of the latch on an opposing side of the pivot axis; and wherein a magnetic coupling between the engagement face and the second lateral portion is greater than the magnetic coupling between the first lateral portion and the engagement face.

5. The magnetic lock according to claim 3, wherein a difference in magnetic coupling exerts the first torque upon the latch for causing the rotation from the first pivot position to the second pivot position.

6. The magnetic lock according to claim 3, wherein the engagement face comprises a first portion and a second portion offset from the first portion, the first and second portion together defining a stepped surface.

7. A magnetic lock that is resistant to defeat caused by forceful impacts, comprising:

a housing formed of a rigid material;

a pin channel defined within the housing, the pin channel arranged to removably receive therein a locking pin along a channel axis;

a latch assembly disposed within the housing, the latch assembly including a latch disposed adjacent to the pin channel, the latch pivotally mounted within the housing, the latch configured to lockingly engage the locking pin when in a first pivot position, and to release the locking pin in a second pivot position, a plunger formed of material responsive to an applied magnetic field, the plunger including an engagement face, a plunger guide channel formed in the housing, the plunger guide channel arranged to facilitate translational movement of the plunger along a guide channel axis from a first position to a second position when the plunger is exposed to the applied magnetic field, and a resilient member arranged to resiliently urge the engagement face of the plunger into contact with a base of the latch;

wherein the latch is responsive to the translational movement of the plunger from the first position to the second position to cause the latch to move from the first pivot position to the second pivot position;

wherein the latch is comprised of a material responsive to the application of a magnetic field and the latch is magnetically coupled to the plunger;

wherein a pivot axis of the latch about which the latch pivots is offset from a center of mass of the latch, and wherein a second lateral portion of the latch on one side of the pivot axis has greater mass than a first lateral portion of the latch on an opposing side of the pivot axis;

wherein the engagement face comprises a first portion and a second portion offset from the first portion, the first and second portion together defining a stepped surface;

wherein the second portion of the stepped surface is in contact with a second portion of the latch base aligned with the second lateral portion.

8. The magnetic lock according to claim 7, wherein a gap is provided between the first portion of the stepped surface and the first portion of the latch base aligned with the first lateral portion.

9. A method for operating a magnetically controlled lock in an electronic article surveillance ("EAS") tag to prevent unauthorized unlocking caused by forceful impacts directed upon the EAS tag, comprising:

securing a first end of a mechanical coupler to a housing of the EAS tag using a locking pin disposed in a pin channel defined within the housing;

removably disposing a second end of the mechanical coupler in a channel other than the pin channel formed within the housing of the EAS tag so that the EAS tag is coupled to an item to be protected by the EAS tag;

applying a magnetic field to a plunger within the housing of the EAS tag to cause a translational movement of the plunger in a first direction; and causing a latch to pivot about a pivot axis by using the translational motion of the plunger to apply a torque to the latch, whereby the latch rotates from a first pivot position in which the latch engages the locking pin for securing the EAS tag to the item to a second pivot position in which the latch is disengaged from the locking pin for allowing a decoupling of the EAS tag from the item.

10. The method according to claim 9, further comprising using a magnetic coupling to apply the torque from the plunger to the latch.

11. The method according to claim 10, further comprising returning the latch to the locked condition in the absence of the magnetic force by using a resilient bias force applied to the plunger to cause the plunger to move in a second direction opposed to the first direction.

12. A method for operating a magnetically controlled lock in an electronic article surveillance tag to prevent unauthorized unlocking caused by forceful impacts directed upon the tag, comprising:

applying a magnetic field to a plunger element within a housing of the tag to cause a translational movement of the plunger in a first direction;

causing a latch to pivot about a pivot axis by using the translational motion of the plunger to apply a torque to a latching element;

using a magnetic coupling to apply the torque from the plunger to the latching element; and selectively controlling an application of the torque from the plunger to the latching element by providing a stepped interface between the plunger and the latching element.

13. An electronic article surveillance ("EAS") tag with a tamper resistant magnetically controlled lock, comprising:

a tag housing;

a movable locking pin disposed within the housing so as to lock a mechanical coupler to a housing;

a rotatable latch disposed within the tag housing, the rotatable latch arranged to selectively engage and disengage the movable locking pin in accordance with a rotation position; and a plunger disposed within the tag housing in a guide channel which facilitates translational movement of the plunger within the tag housing along a translational axis, the plunger resiliently biased toward the rotatable latch;

wherein the plunger is arranged to apply a first torque to the rotatable latch responsive to movement of the plunger in a first direction along the translational axis in the presence of an applied magnetic field to rotate the rotatable latch (a) from a first pivot position in which the rotatable latch engages the movable locking pin so as to allow the EAS tag to be coupled to an item to be protected (b) to a second pivot position in which the rotatable latch disengages from the movable locking pin for allowing the EAS tag to be decoupled from the item.

14. The EAS tag according to claim 13, further comprising:

a resilient member arranged to provide the resilient bias for the plunger, the resilient member arranged to cause the plunger to move in a second direction opposed to the first direction when the applied magnetic field is removed; and wherein the plunger is arranged to apply a second torque to the rotatable latch responsive to movement of the rotatable latch in the second direction, to re-engage the rotatable latch with the movable locking pin.

15. The EAS tag according to claim 14, further comprising a pin channel formed within the tag housing and arranged to constrain a movement of the movable locking pin along a linear path transverse to the first and second directions.

16. The EAS tag according to claim 15, wherein the rotatable latch and the plunger are formed of a ferromagnetic material.

17. The EAS tag according to claim 16, wherein the rotatable latch is magnetically coupled to the plunger when the plunger is in the presence of the applied magnetic field.

18. An electronic article surveillance tag with a tamper resistant magnetically controlled lock, comprising:

a tag housing;

a rotatable latch disposed within the tag housing, the latch arranged to selectively engage and disengage a movable locking pin in accordance with a rotation position; and a plunger disposed within the tag housing in a guide channel which facilitates translational movement of the plunger within the tag housing along a translation axis, the plunger resiliently biased toward the latch;

wherein the plunger is arranged to apply a first torque to the latch responsive to movement of the plunger in a first direction along the translational axis in the presence of an applied magnetic field to rotate the latch, whereby the latch is caused to disengage from the locking pin;

wherein the latch and the plunger are formed of a ferromagnetic material;

wherein the latch is magnetically coupled to the plunger when the plunger is in the presence of the applied magnetic field; and wherein the first torque is selectively coupled from the plunger to the latch by providing a stepped interface surface between the plunger and the latch.

19. The EAS tag according to claim 13, wherein a pivot axis of the rotatable latch about which the rotatable latch rotates is offset from a center of mass of the rotatable latch, such that a second lateral portion of the rotatable latch on one side of the pivot axis has greater mass than a first lateral portion of the rotatable latch on an opposing side of the pivot axis.

20. The EAS tag according to claim 19, wherein an engagement face of the plunger which interacts with the rotatable latch comprises a first portion and a second portion offset from the first portion, the first and second portion together defining a stepped surface.

21. An electronic article surveillance tag with a tamper resistant magnetically controlled lock, comprising:

a tag housing;

a rotatable latch disposed within the tag housing, the latch arranged to selectively engage and disengage a movable locking pin in accordance with a rotation position;

a plunger disposed within the tag housing in a guide channel which facilitates translational movement of the plunger within the tag housing along a translation axis, the plunger resiliently biased toward the latch;

wherein the plunger is arranged to apply a first torque to the latch responsive to movement of the plunger in a first direction along the translational axis in the presence of an applied magnetic field to rotate the latch, whereby the latch is caused to disengage from the locking pin wherein a pivot axis of the latch about which the latch rotates is offset from a center of mass of the latch, such that a second lateral portion of the latch on one side of the pivot axis has greater mass than a first lateral portion of the latch on an opposing side of the pivot axis;

wherein an engagement face of the plunger which interacts with the latch comprises a first portion and a second portion offset from the first portion, the first and second portion together defining a stepped surface; and wherein the second portion of the stepped surface is in contact with a second portion of the latch base aligned with the second lateral portion.

22. The electronic article surveillance tag according to claim 21, wherein a gap is provided between the first portion of the stepped surface and the first portion of the latch base aligned with the first lateral portion.

* * * * *